United States Patent [19]

Manning et al.

[11] Patent Number: 5,002,259

[45] Date of Patent: Mar. 26, 1991

[54] POWER WINCH SYSTEM

[75] Inventors: David J. Manning, Torrington, Wyo.; William L. Watson, Morrill, Nebr.

[73] Assignee: Helper Winch, Inc., Torrington, Wyo.

[21] Appl. No.: 137,426

[22] Filed: Dec. 22, 1987

[51] Int. Cl.[5] ..... B66D 1/14; B66D 5/02

[52] U.S. Cl. ..... 254/350; 192/93 A; 254/356; 254/358; 254/368; 254/375; 254/380

[58] Field of Search ..... 192/93 A, 70.23, 70.24; 254/350, 358, 359, 342, 346, 348, 356, 368, 365, 375, 376, 380

[56] References Cited

U.S. PATENT DOCUMENTS

| | | | |
|---|---|---|---|
| 1,768,278 | 6/1930 | Whitaker, Jr. . | |
| 1,931,655 | 10/1933 | Haseltine . | |
| 2,080,804 | 5/1937 | Brantly . | |
| 2,151,338 | 3/1939 | Shonnard | 254/350 X |
| 2,278,022 | 3/1942 | Rodgers | 254/368 X |
| 2,309,285 | 1/1943 | Walton . | |
| 2,515,805 | 7/1950 | Simmons | 254/368 |
| 2,869,822 | 1/1959 | Shurtliff . | |
| 3,036,435 | 5/1962 | Samuely | 254/361 |
| 3,220,701 | 11/1965 | Clausen | 254/368 |
| 3,291,452 | 12/1966 | Rau et al. . | |
| 3,322,398 | 5/1967 | Smith | 254/346 |
| 3,411,751 | 11/1968 | Pooley, Jr. . | |
| 3,871,714 | 3/1975 | Behrend . | |
| 3,915,022 | 10/1975 | Walton . | |
| 3,938,781 | 2/1976 | Craven et al. | 254/342 |
| 4,109,799 | 8/1978 | Munn . | |
| 4,145,028 | 3/1979 | Kelley et al. . | |
| 4,162,059 | 7/1979 | Fletchall . | |
| 4,169,580 | 10/1979 | Hatlapa et al. . | |
| 4,188,790 | 2/1980 | Pedersen . | |
| 4,196,889 | 4/1980 | Dudek . | |
| 4,444,375 | 4/1984 | Horn | 254/358 |
| 4,552,340 | 11/1985 | Sheppard | 254/358 |
| 4,553,738 | 11/1985 | Plummer | 254/358 |
| 4,623,124 | 11/1986 | Lewis | 254/361 |

FOREIGN PATENT DOCUMENTS

| | | |
|---|---|---|
| 474214 | 2/1915 | France . |

*Primary Examiner*—Stuart S. Levy
*Assistant Examiner*—Katherine Matecki
*Attorney, Agent, or Firm*—Dean P. Edmundson

[57] ABSTRACT

A power winch is described which includes drive means with an output shaft, lock means to prevent reverse rotation of the shaft and a drum clutch assembly. The drum can be selectively engaged with or disengaged from the drum shaft. The lock means prevents the drum from rotating in reverse when it is engaged with the drum shaft. The power winch can be made compact and portable and can be powered by a small internal combustion engine.

23 Claims, 5 Drawing Sheets

POWER WINCH SYSTEM

FIELD OF THE INVENTION

This invention relates to winch systems. More particularly, this invention relates to power winch systems having a rotatable drum and a length of flexible cable wound around the drum. This invention also relates to light-weight winch systems which are self-contained and portable.

BACKGROUND OF THE INVENTION

There are innumerable situations which arise daily in which it is necessary or desirable to lift or move a heavy object. Various devices have been previously developed, of course, as aids in lifting or moving heavy objects. Included in a listing of such devices are winches of various types and descriptions.

Winches are used in various industries and applications today. Although a winch may be operated manually (e.g., a simple block and tackle), the preferred use is with the aid of a power source (e.g., an electric motor or gasoline engine).

There are many potential uses for a power winch in remote locations. For example, a power winch can be extremely useful in the field for moving timber, or towing a vehicle out of mud, snow or water, or moving large game animals which have been killed while hunting. Although electrically powered winches are available for mounting on the front of vehicles, such winches have several limitations.

For example, they can only be used when the vehicle engine is running. Thus, if the vehicle engine is disabled for any reason the winch cannot be used. Also, such winches are mounted on the front of the vehicle. Many times, however, it is necessary to tow or winch a vehicle rearwardly or even sideways to dislodge it.

Furthermore, such winches which are mounted on vehicles are of no use unless the vehicle can be driven to the location where the winch is needed. There are many situations in which it is not possible, because of the terrain, for a vehicle to be driven to the location where the winch is needed. For example, while hunting in mountainous or rough country it is often desirable to have a winch to move animals which have been killed, but it is not possible to drive to the location where the winch is required.

There are many situations where when using a winch it is necessary or desirable to be able to stop the winch during operation and yet hold a load without slippage. There are other situations where it is desirable to release the drum in a controlled manner in order to allow it to reverse slowly (e.g., to lower a load which has been raised with the winch).

It is also often necessary or desirable to be able to unwind the drum to pay out lengths of cable (e.g., in order to pull the free end of the cable from the drum to the object to be winched). Many winches do not include means for uncoupling the drum from the drive means for this purpose. Other winches may have this capability but are cumbersome or unsafe to use.

A further problem presented in the use of a winch system pertains to release of tension on the cable. In many situations it is necessary or desirable to be able to disconnect the cable from the object being winched but some tension remains on the cable. For example, the object being winched may roll or slide very slightly in a backward direction but is not in danger of rolling away or sliding away if disconnected from the winch. In this situation it can be difficult, if not impossible, to disconnect the cable from the object being winched.

A few portable power winches and hoists have been proposed. See, for example, U.S. Pat. Nos. 3,036,435; 3,322,398; 3,938,781; 4,145,028; 4,162,059; 4,196,889; 4,444,375; 4,552,340; and 4,623,124. These patents describe portable winches which are powered by gasoline engines. Such winches do not include the advantages exhibited by the power winch systems of the present invention. Also, many of such prior winch systems do not have good power-to-weight ratios, and they are limited in towing capacity. They also can be very slow in operation.

There is a very serious disadvantage associated with previous proposed winches, including portable winches, which utilize a centrifugal clutch on the power unit If the power unit should ever stop for any reason, or if its speed drops too low, the centrifugal clutch automatically disengages and the drum is free to rotate in reverse (i.e., the load on the cable pulls away from the winch and the drum unwinds very quickly as cable is pulled off of it). This presents a very dangerous situation. For example, if a load is being lifted off the ground when the clutch disengages, the load immediately falls downwardly and could injure someone. Even if a brake is included on a winch to slow or stop the drum from rotating in reverse, human reflexes are not fast enough to cause the brake to be engaged before the load has already fallen to the ground or increased in speed to the point where the brake won't hold it. If it is possible to lock a brake on the drum manually there is the very real danger of causing severe damage to the winch or the operator or both when the cable is finally suddenly stopped. These are safety hazards which can render use of such devices dangerous.

Other winch systems, hoists, transmissions, etc. are described in the following: U.S. Pat. Nos. 1,768,278; 1,931,655; 2,080,804; 2,309,285; 2,869,822; 3,291,452; 3,411,751; 3,871,714; 3,915,022; 4,109,799; 4,169,580; and 4,188,790. A winch system is also described in French Patent 474,214. However, such winch systems and hoists are not light-weight and are not portable systems which can be used at any desired remote location where a winch is needed. Furthermore, none of such patents describe a drum clutch assembly having the features and advantages provided by the present invention.

There has not heretofore been provided a portable, self-contained winch system of the type provided by the present invention. There has not heretofore been provided a winch system having the capabilities and advantages of the winch system of this invention.

SUMMARY OF THE PRESENT INVENTION

In accordance with the present invention there is provided, in one embodiment, a portable, self-contained, winch system which is powered by a gasoline engine. The winch can be carried easily to any remote location where it is needed. It is compact light-weight and easy to operate.

The portable winch system of the invention, in one embodiment, comprises:

(a) drive means including an output shaft which is adapted to be rotatably driven in a forward direction;

(b) lock means adapted to lock the output shaft to prevent rotation thereof in a reverse direction; and (c) drum clutch assembly comprising:

(i) an elongated drum shaft having first and second ends;

(ii) support means adapted to support the ends of the drum shaft;

(iii) drive sprocket secured to the first end of the drum shaft; the drive sprocket being adapted to rotatably drive the drum shaft; wherein the output shaft of the drive means is operably connected to the drive sprocket;

(iv) drum means rotatably carried on the drum shaft;

(v) clutch means carried by the drum shaft and being adapted to selectively engage and disengage the drum means from the drum shaft; wherein the drum means is caused to rotate with the drum shaft when the clutch means is engaged; and wherein the drum means may be rotated independently of the drum shaft when the clutch means is engaged; and (vi) an elongated flexible cable having first and second ends; wherein the first end is secured to the drum means, and wherein the cable is adapted to be wound around the drum means when the drum means is driven by the drum shaft.

Alternatively, the lock may be operatively connected to the drum shaft instead of to the output shaft.

The winch system and drum clutch assembly of the invention can be provided in various embodiments. A preferred form of winch system of the invention is portable.

The portable winch system of this invention is self-contained and can be used anywhere. Any desired size of gasoline engine may be used, depending upon the amount of power desired. The entire winch system may be made light duty, medium duty, or heavy duty, as desired.

The speed of rotation of the drum (and therefore the speed of the cable) is controlled by the speed of the power unit (e.g., gasoline engine). A throttle control on the engine allows the operator to change engine speed easily and quickly.

The portable winch system of this invention is very compact, with good pulling power-to-weight ratios. It is also smooth in operation. The winch system of this invention is also versatile in its design and easy to manufacture.

The winch systems of the invention can be provided in various forms, portable and non-portable. The presence of the lock means prevents the drum from rotating in reverse. This is a very significant safety feature because the drum cannot reverse in the event the power is discontinued for any reasón. This prevents a load from slipping away from the winch and possibly causing injury or damage. With this system it is not necessary to have a brake.

The winch systems of this invention also include a unique drum assembly which enables the drum to be selectively disengaged so that the cable can be drawn off the drum (e.g., as may be necessary to release tension on the cable or to allow the cable to be unwound from the drum).

On conventional winch systems which use pins or bolts to lock the drum, the presence of tension on the cable interferes with the ability to disconnect the pins; therefore tension interferes with disconnecting the cable from the load.

Other advantages of the power winch system and drum clutch assembly of this invention will be apparent from the following description and the appended drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
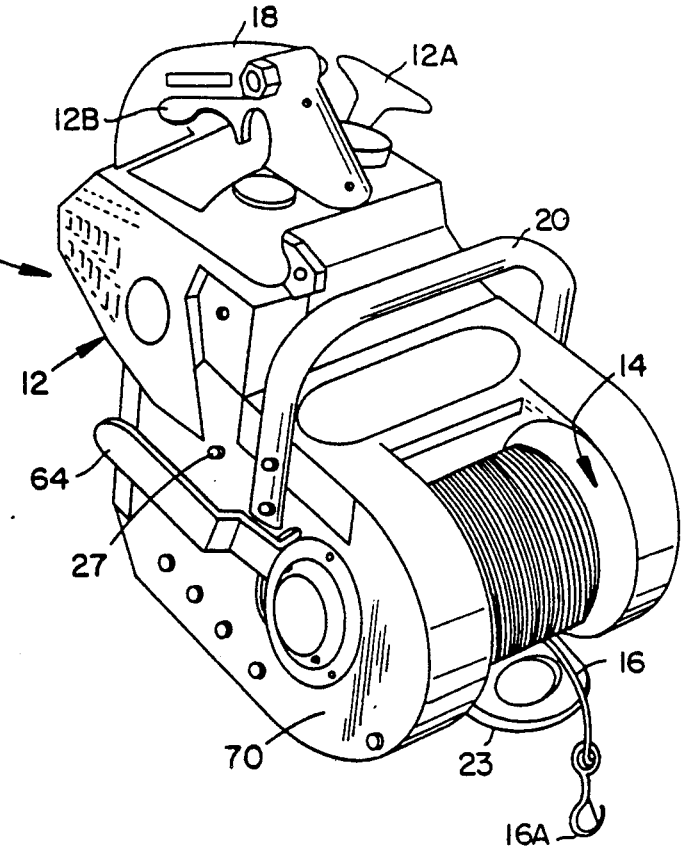
FIG. 1 is a front perspective view of one embodiment of a portable winch system of the invention.

In FIGS. 1–4 there is illustrated a preferred embodiment of portable power winch system 10 of the invention. The winch includes a power unit 12, and rotatable drum 14, and a length of flexible cable 16 wound around the drum. The cable has one end secured to the drum and the free end preferably includes a hook 16A to facilitate attachment to the desired object to be winched or to a suitable anchoring object, depending upon how the winch is desired to be used.

Handle 18 attached to the power unit and handle 20 attached to side members 70 provide convenient means for carrying the winch system 10 and for holding it when it is being used. This arrangement of handles provides for convenient and well-balanced handling of the winch system.

Hook 22 secured to the frame at the rear of the unit serves as a connection means for anchoring the winch system to a fixed object when towing or pulling another object with the steel cable on the drum. Alternatively, the steel cable could be anchored (e.g., to a tree or large rock, fixed object, etc.) and the hook 22 could be attached to the object to be towed or pulled.

Hook 23 at the front of the winch system is useful when a pulley with a hook on it is carried on the cable and the hook 16A is attached to hook 23. This is sometimes referred to as a snatch block arrangement.

The hooks 22 and 23 included as part of the winch unit are adapted and designed to fit over a conventional ball hitch on a vehicle. In this manner the winch unit can be quickly put to use without the need for a chain, cable, etc. to anchor the winch to a fixed object.

Handle 12A is attached to the recoil starter for the power unit 12. Throttle 12B controls the speed of the engine.

The gasoline engine used in the portable winch of the invention is preferably small and light in weight. The displacement of the engine may vary (for example, from about one to three cubic inches, with two cubic inches being preferred) depending upon the power desired.

A convenient type of engine to be used on portable winches of the invention is a two cycle engine of the type used on chain saws. Such engines are manufactured and commercially available in a variety of sizes by various companies, as is well-known in the art.

The chain saw engine is very desirable for use in this invention for another reason also, i.e., such type of engine includes a centrifugal clutch of the type desired for use in the winch system of this invention. The centrifugal clutch operably connects the output shaft of the gasoline engine to the gear box. The centrifugal clutch does not engage when the gasoline engine is at idle or low speed. As the speed of the engine increases the clutch becomes engaged.

This type of clutch therefore allows the gasoline engine to be started (and also allows it to idle) without any load on it. Then, when it is desired to engage the drum reel and rotate it, all that is necessary is to increase the speed of the engine using the throttle. Once the engine reaches a predetermined speed the centrifugal clutch engages and then drives the output shaft. As the engine speed is decreased below the predetermined speed the clutch disengages the output shaft. The predetermined speed referred to here is normally that which is determined by the manufacturer of the clutch. The actual speed at which the clutch engages is not critical so long as the clutch is not engaged when the gasoline engine is at idle or at a low speed.

Figure 2:
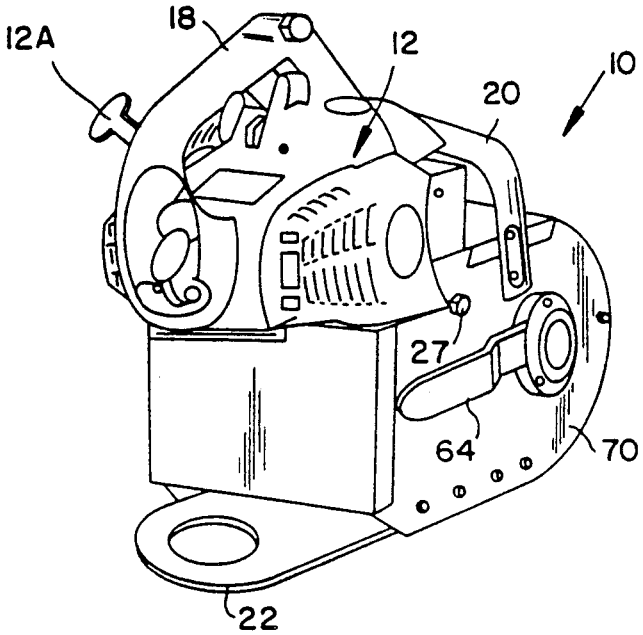
FIG. 2 is a rear perspective view of the embodiment of portable winch system shown in FIG. 1.
Figure 3:
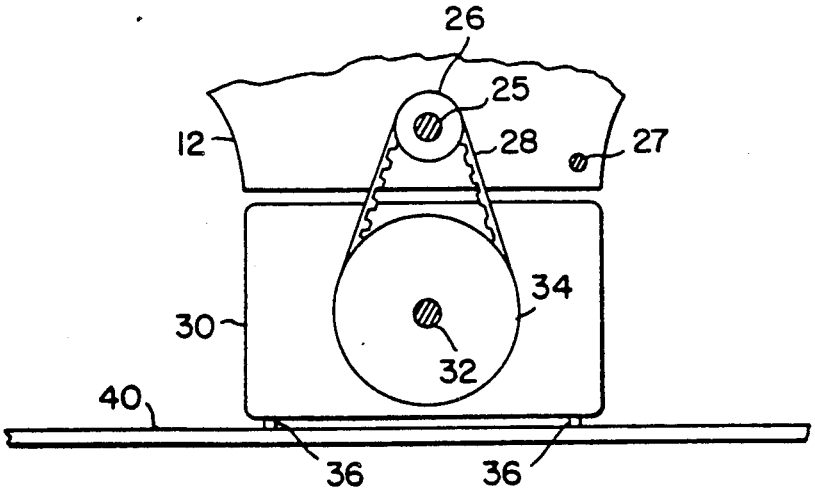
FIG. 3 is a fragmentary side elevational view, partially cut away, of the portable winch shown in FIGS. 1 and 2.

In FIG. 3 there is shown a fragmentary side elevational view, partially cut away, of the winch embodiment shown in FIGS. 1 and 2. In this view there is shown the end of power output shaft 25 extending outwardly from the engine 12. A pulley 26 is secured to the shaft 25 and rotates with the shaft.

Endless belt 28 transfers rotational motion from shaft 25 and pulley 26 directly downwardly to pulley 34 secured to the input shaft 32 of a gear reduction box 30 located directly below the engine 12, as illustrated. Bolts 27 secure the engine to the side members 70 of the winch system above the gear box. Bolts 36 secure the gear box to a base plate 40 which may form part of a frame for the winch unit.

Preferably belt 28 is a tough rubber belt having ribs or lugs on its inner surface as illustrated in FIG. 3. This type of belt is conventionally used as a timing belt in certain internal combustion engines. It is very durable and does not require lubrication.

Alternatively, pulleys 26 and 34 could be replaced with conventional gears and the belt 28 could be replaced with a chain, if desired. In such event, occasional lubrication would be desirable.

The gear box reduces the rotational speed from the input shaft to the output shaft. The amount of the reduction may vary, as desired (e.g., from 20:1 to 100:1). Additional speed reduction from the speed of the output shaft of the power unit may be provided either before or after reaching the gear box. For example, there may be a speed reduction by means of different size pulleys on the output shaft of the engine and the input shaft of the gear box. There may also be a speed reduction between the output of the gear box and the drum shaft or axle by means of different size pulleys or gears used. The total speed reduction from the engine speed to the drum speed may be from 100:1 to 300:1, for example.

A conventional gear box system which is useful in this invention is conventionally available from Dayton Manufacturers. The gear box may be provided with different amounts of speed reduction. For example, one model provides a 24:1 reduction and another commercial model provides a 53:1 reduction. Other types of gear boxes may also be used, of course.

Figure 4:
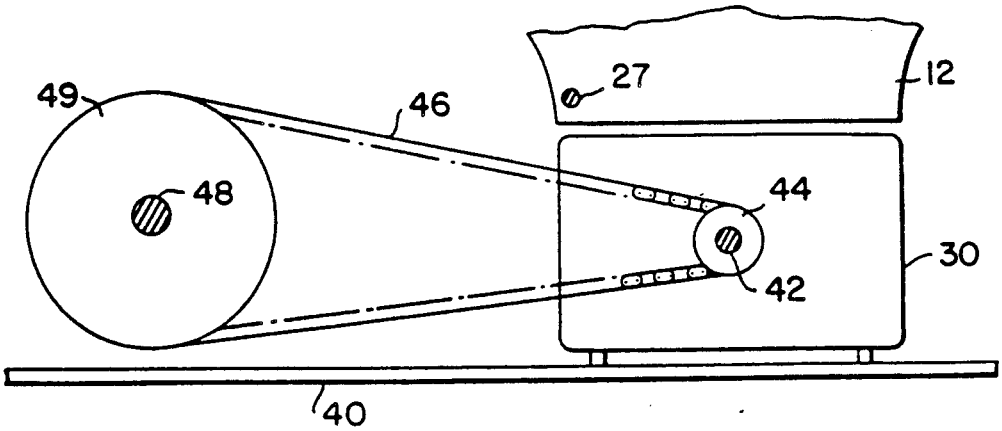
FIG. 4 is a fragmentary side elevational view, partially cut away, showing the opposite side of said portable winch.

FIG. 4 is a fragmentary side elevational view, partially cut away, showing the opposite side of the winch unit of FIGS. 1 and 2. Thus, there is shown output shaft 42 to which there is secured pulley or gear 44. A chain or belt 46 extends around pulley or gear 44 and pulley or gear 49 secured to drum shaft 48. In this manner rotational motion is transferred from rotating shaft 42 to drum shaft 48.

Figure 5:
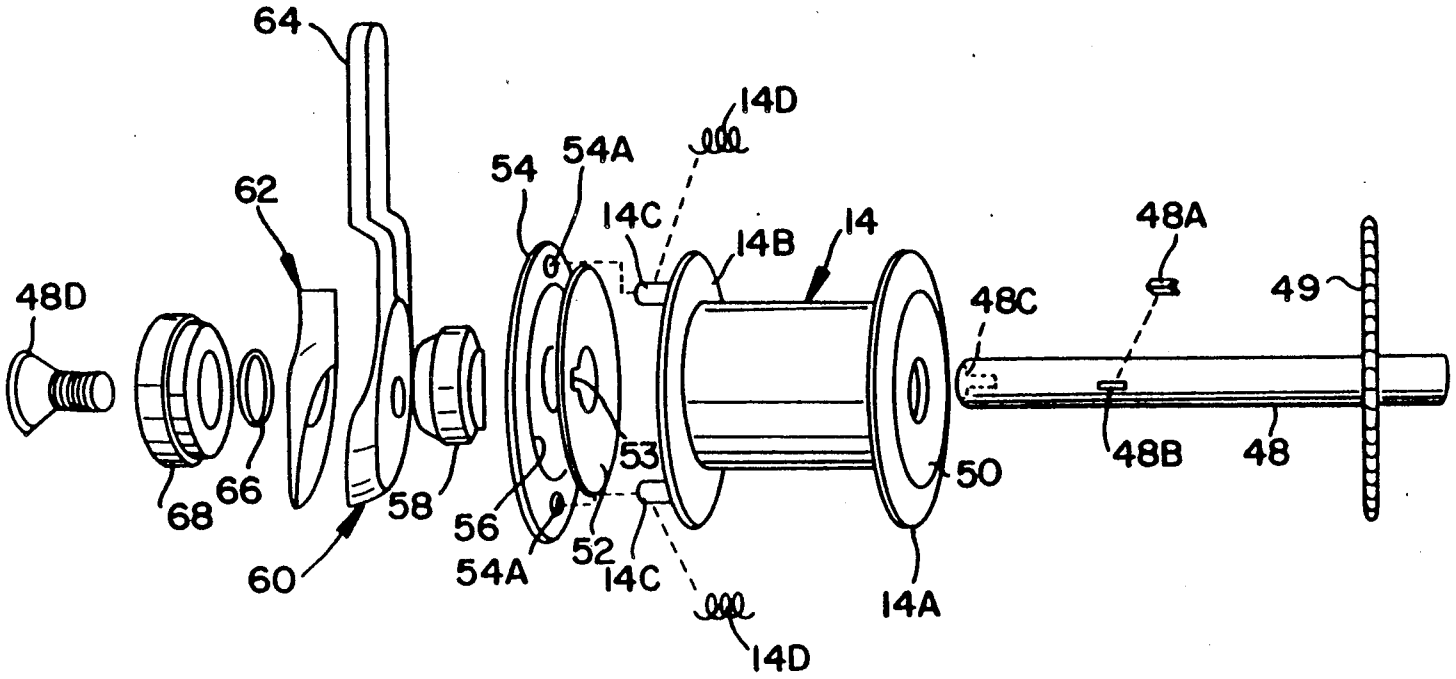
FIG. 5 is an exploded perspective view of a preferred embodiment of a drum clutch assembly of this invention.
Figure 6:
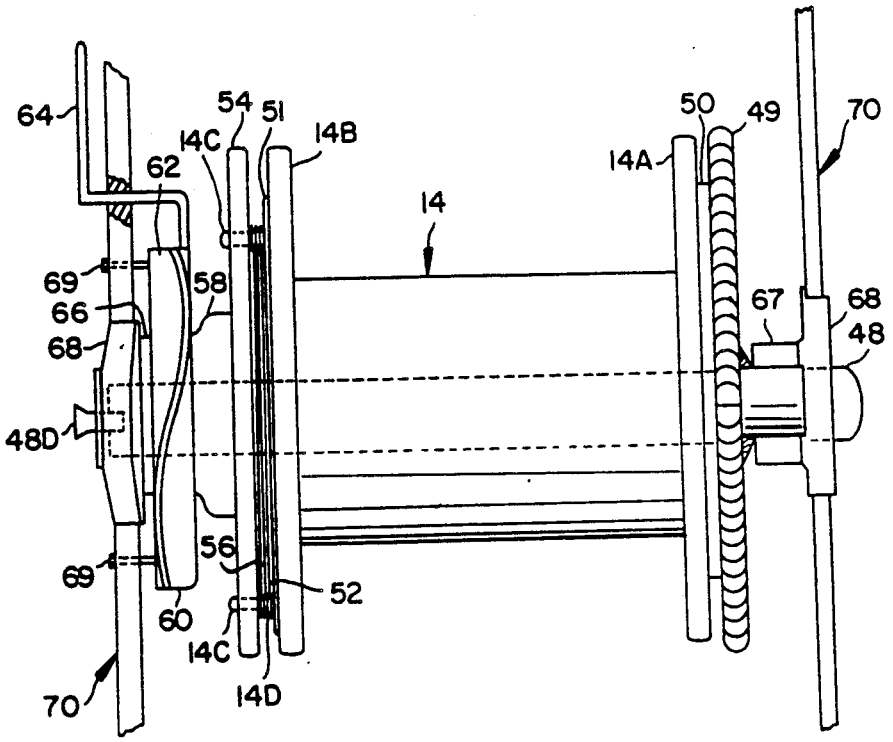
FIG. 6 is a front view of the drum clutch assembly supported in a winch system of the invention.

In FIGS. 5 and 6 there is shown a preferred embodiment of drum clutch assembly for use in the winches of this invention. FIG. 5 is an exploded perspective view and FIG. 6 is a front elevational view of the assembly in operational form.

Drum 14 has a central longitudinal opening through it which is slightly larger than drum shaft 48. This enables the drum to slide onto the shaft 48, but the drum may rotate freely relative to shaft 48. The ends of the drum include end plates 14A and 14B, respectively.

A fiber clutch disk 50 is shown secured to the outside surface of end plate 14A. Alternatively, the clutch disk 50 could be secured to the inner surface of sprocket 49. As another alternative, the clutch disk could simply be free floating on shaft 48.

Preferably another clutch disk 51 is secured to the outer surface of plate 14B at the opposite end of drum 14.

Adjacent end plate 14B is a pressure plate 52 which fits over shaft 48 and includes a notched central opening 53. Key 48A fits into cavity or slot 48B in shaft 48 and also fits into the notched opening 53 in pressure plate 52. This causes plate 52 to be fixed rotationally to shaft 48. Plate 52, however, can move axially on shaft 48 as explained in more detail hereafter.

Pressure plate 54 also fits over shaft 48 and is free floating, both rotationally and axially, relative to shaft 48. Plate 54 includes one or more apertures 54A at its periphery which are aligned such that they will slidably receive pins 14C carried by the periphery of plate LAB. Preferably spring members 14D are carried by pins 14C to bias plate 54 away from plate 14B.

A fiber clutch disk 56 is secured to plate 54 and is adapted to frictionally engage plate 52 when plate 54 is urged toward plate 52. Alternatively, clutch disk 56 could be secured to the opposing face of plate 52. As another alternative, the clutch disk could be free floating on shaft 48.

Clutch disk 51 is preferably secured to plate 14B, as explained above. However, it could instead be secured to the opposing face of plate 52, if desired. It could also be free floating on shaft 48.

Adjacent plate 54 on shaft 48 is a conventional thrust bearing 58. It is free floating on shaft 48. The thrust bearing enables axial pressure to be applied to it without interfering with rotational motion.

A variable thrust mechanism is carried by the shaft 48 adjacent the thrust bearing 58. The variable thrust mechanism includes mating sections 60 and 62. Section 62 is secured to the frame or drum support so that it will not rotate or move axially relative to shaft 48. A handle member 64 is secured to section 60, as illustrated.

Figure 7:
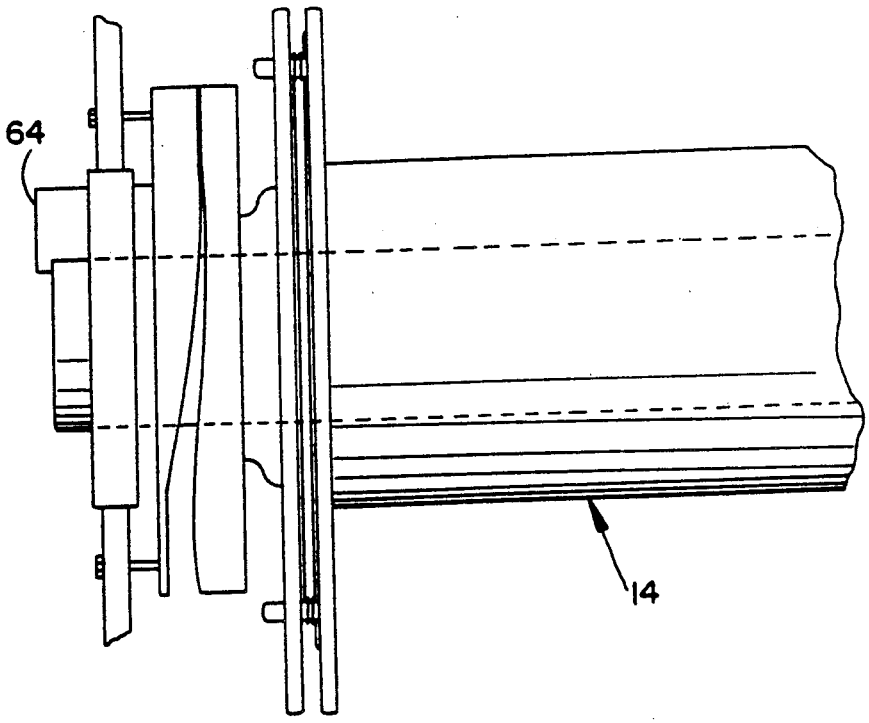
FIG. 7 is a fragmentary front view of the drum clutch assembly of FIG. 6 in which the variable thrust means is in a position for causing the drum to be rotatably driven by the drum shaft and the drive sprocket.

Variable thrust sections 60 and 62 have mating surface configurations which are non-planar. Preferably the mating surfaces are sloped (i.e., they include ramps)

so that the two sections are forced apart gradually and smoothly when section 60 is rotated by means of handle 64. In this manner, movement of handle 64 downwardly forces thrust bearing 58 toward pressure plate 54. In turn, plate 54 is urged against pressure plate 52, and plate 52 is urged toward end plate 14B. Drum 14 is in turn urged toward sprocket 49. The effect is to cause plate 54 and drum 14 to be engaged and driven rotationally by shaft 48 and sprocket 49. This is illustrated in FIG. 7.

Carriage bearings 68 fit over both ends of the shaft 48 and are supported by the drum support or frame. A spacer 66 can be positioned over the shaft 48 between the carriage bearing and section 62 of the variable thrust mechanism. The spacer maintains proper position of section 62 relative to section 60. Bolts 69 extend through side frame member 70 and engage section 62 to prevent rotational movement thereof. Spacer 67 may be placed over the opposite end of the shaft, as illustrated.

When the handle 64 is moved to its upward position, the sections 60 and 62 come into mating engagement again. Spring members 14D then urge pressure plate 54 away from drum 14. Drum 14 may also move slightly away from sprocket 49. The net effect is that drum 14 becomes disengaged and can be rotated free of shaft 48.

Adjustment screw 48D is adapted to engage a threaded opening 48C in the end of shaft 48. This screw is used to adjust for slippage by the clutch disks. The screw head is tapered and is adapted to bear against the outer edge of carriage bearing 68. Thus, as the screw is turned inward, the screw head bears against the carriage bearing and pulls shaft 48 slightly toward screw 48D. This type of adjustment tightens the drum clutch assembly slightly. It is advantageous to do this when wear of the clutch disks allows them to slip more than desired. Conversely, if more slippage is desired, the screw may be loosened slightly.

In another embodiment there may be only a single clutch disk (e.g., secured to the outer end of the drum end plate 14A). In such case it is not necessary to include pressure plates 52 and 54. The thrust bearing would in such case urge the drum toward sprocket 49 when the handle 64 is moved downwardly. For lighter duty applications this arrangement may be suitable.

A significant advantage of the clutch arrangement used in the present invention is that any desired amount of slippage between the drum and the rotating shaft can be obtained. Thus, if for any reason it is desired to have a certain amount of slippage between the drum and the shaft, this can be provided. For example, by controlling the degree of slippage in the clutch system it is possible to use it as a safety feature (e.g., to prevent overload of the gear box or other parts of the winch unit).

It is also possible, of course, to allow the drum to rotate free of the shaft when the clutch is disengaged. This enables the drum to be rotated in reverse direction (e.g., to remove cable from the drum to extend it to the object to be winched or to reach a stationary object to be used as an anchor).

The clutch disks used in this invention are conventional and are commercially available. For example, these clutch disks are available from Friction Products Co., Friction Materials Mfg. Co., and others. The metal surface against which each disk is urged in order to engage the drum is smooth but not highly polished. It is desired to have the clutch disk engage the metal surface without a grabbing or jerky motion.

Figure 8:
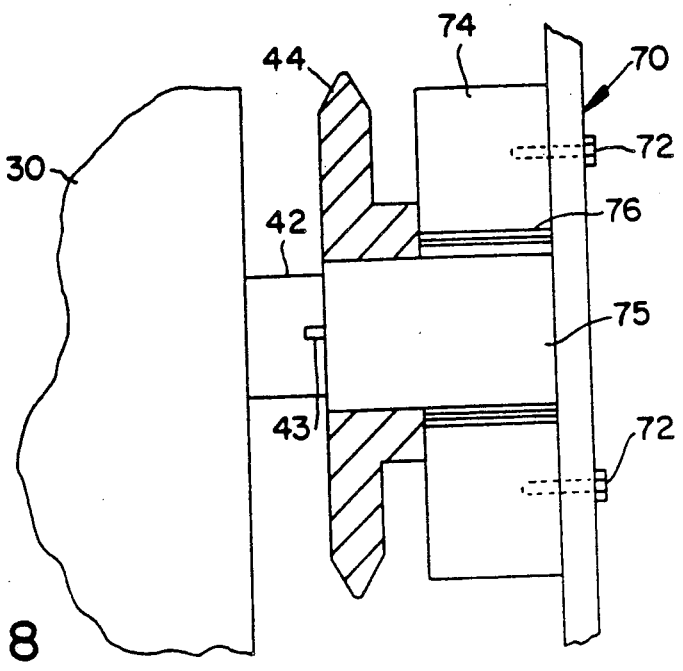
FIG. 8 is a top view, partially cut away, illustrating a preferred embodiment of lock means used in the winch system of this invention.

FIG. 8 is a top view, partially cut away, illustrating a preferred embodiment of lock means used in the winch system of this invention. The same or similar lock system may be used on both the input shaft of the gear box 30 as well as on the output shaft of the gear box. FIG. 8 illustrates the lock system as applied to the output shaft 42 of the gear box.

A hardened sleeve 75 is fitted around the end of shaft 42. A sprocket or pulley 44 may be fitted onto the hardened sleeve and both can then be keyed to shaft 42, if desired, by means of key 43. Alternatively, the sprocket can be keyed to the shaft and the sleeve 75 can be welded onto the outer end of the shaft. A lock bearing 76 surrounds sleeve 75.

The lock bearing 76 may be, for example, a one-directional needle bearing which enables the sleeve (and accordingly shaft 42) to rotate freely in a forward direction only. The bearing will not permit rotation of the sleeve in a reverse direction. Housing 74 supports the bearing 76 and is secured to the frame support by means of bolts 72, as illustrated.

Lock bearings of this type are commercially available, e.g., from Torrington Manufacturers and others. As used in the winch system of this invention, the lock bearings serve as a safety lock to prevent pulling force on the cable from causing the drum to rotate in reverse. In other words, even an excessive load on the cable cannot cause the gear box to turn in reverse because the output shaft is locked against reverse rotation. This is a very significant safety advantage. The system always automatically locks to prevent reverse rotation of the drum in the event there is a power failure or if the engine speed slows to a point where the centrifugal clutch disengages.

Because of the type of the locking system used in the winch systems of this invention it is not necessary to include a manual braking system. Instead, the locking system prevents undesired reverse rotation of the drum.

As another alternative, the locking system may be included on the drum shaft instead of on the shafts of the gear box. As yet another alternative, such a locking system can be included on each shaft (i.e., drum shaft, output shaft of gear box, and input shaft of gear box).

In the winch systems of this invention, there are many variations which are possible. For example, the amount of speed reduction from the engine to the drum may vary from 100:1 to 300:1.

The drum size may also vary, for example, from a diameter of about 3 inches to a diameter of about 5 inches (with a diameter of 4 inches being preferred). The length or width of the drum may also vary (e.g., from 4 to 6 inches, normally).

The length and size of the flexible cable may also vary. For example, the length may vary from about 50 to 300 feet for portable units. The diameter may vary from about 3/32 inch to ¼ inch, for example, in such units.

Other variations of the power winch system are also possible without departing from the scope of the present invention. The load capacity of the winch system may vary, as desired, depending upon the size of the power unit and the capacity of the flexible cable.

The winch system may be provided as a small portable unit or as a large non-portable unit. The winch may be powered by any desired means, such as a gasoline engine. It could also be powered manually if desired.

What is claimed is:

1. A power winch comprising:

(a) drive means including an output shaft which is adapted to be rotatably driven in a forward direction;

(b) lock means adapted to lock said output shaft to prevent rotation thereof in a reverse direction; and (c) a drum clutch assembly comprising:

(i) an elongated drum shaft having first and second ends;

(ii) support means adapted to support said ends of the drum shaft;

(iii) a driven sprocket secured to said first end of said drum shaft; said drive sprocket being adapted to rotatably drive said drum shaft; wherein said output shaft of said drive means is operably connected to said drive sprocket;

(iv) drum means rotatably carried on said drum shaft; wherein said drum means includes first and second ends;

(v) clutch means carried by said drum shaft and being adapted to selectively engage and disengage said drum means from said drum shaft; wherein said drum means is caused to rotate with said drum shaft when said clutch means is engaged; and wherein said drum means may be rotated independently of said drum shaft when said clutch means is disengaged; wherein said clutch means comprises:

(a) a first clutch disk disposed between said first end of said drum and said drive sprocket;

(b) a first pressure plate carried by said drum shaft adjacent said second end of said drum means, said first pressure plate being rotatably fixed to said drum shaft but being axially movable relative to said drum shaft;

(c) a second clutch disk disposed between said second end of said drum and said first pressure plate;

(d) a second pressure plate carried by said drum shaft adjacent said second clutch disk; wherein said second pressure plate is rotationally fixed to said drum means;

(e) variable thrust means carried by said drum shaft and being adapted to urge said first and second pressure plates toward said second clutch disk and to urge said first clutch disk against said drive sprocket; wherein said drum means is rotatably driven by said drum shaft and said drive sprocket; and (vi) an elongated flexible cable having first and second ends; wherein said first end is secured to said drum means, and wherein said cable is adapted to be wound around said drum means when said drum means is driven by said drum shaft.

2. A power winch in accordance with claim 1, wherein said drive means comprises:

(a) motor means including a power shaft which is driven in a rotatable manner;

(b) a gear box which includes an input shaft and said output shaft, wherein said power shaft of said motor means is operably connected to said input shaft of said gear box;

wherein said output shaft of said gear box is driven at a slower speed than said input shaft; wherein said output shaft is operably connected to said drive sprocket of said drum clutch assembly.

3. A power winch in accordance with claim 2, wherein said motor means comprises an internal combustion engine.

4. A power winch in accordance with claim 3, wherein said power shaft is operably connected to said input shaft of said gear box by means of a belt.

5. A power winch in accordance with claim 2, further comprising frame means adapted to support said gear box and said drum clutch assembly.

6. A power winch in accordance with claim 5, wherein said engine is mounted to said frame means above said gear box.

7. A power winch in accordance with claim 5, wherein said lock means comprises a first lock bearing carried by said output shaft of said gear box and supported by said frame means, wherein said lock bearing permits said output shaft to be rotatably driven in a forward direction and prevents said output shaft from being driven in a reverse direction.

8. A power winch in accordance with claim 7, further comprising a second lock bearing carried by said input shaft of said gear box and supported by said frame means, wherein said lock bearing permits said input shaft to be rotatably driven in a forward direction and prevents said input shaft from being driven in a reverse direction.

9. A power winch in accordance with claim 1, further comprising a third clutch disk secured to said second pressure plate on the surface facing said first pressure plate.

10. A power winch in accordance with claim 9, wherein said variable thrust means includes a handle which is movable between first and second positions to selectively engage and disengage said drum means from said drum shaft.

11. A winch of the type including drive means having an output shaft which is capable of being rotatably driven in a forward direction; said winch comprising:

(a) lock means adapted to lock said output shaft to prevent rotation thereof in a reverse direction;

(b) a drum clutch assembly comprising:

(i) an elongated drum shaft having first and second ends;

(ii) support means adapted to support said ends of the drum shaft;

(iii) a drive sprocket secured to said first end of said drum shaft; said drive sprockets being adapted to rotatably driven said drum shaft; wherein said output shaft of said drive means is operably connected to said drive sprocket;

(iv) drum means rotatably carried on said drum shaft;

(v) clutch means carried by said drum shaft and being adapted to selectively engage and disengage said drum means from said drum shaft; wherein said drum means is caused to rotate with said drum shaft when said clutch means in engaged; and wherein said drum means may be rotated independently of said drum shaft when said clutch means is disengaged; wherein said clutch means comprises:

(a) a first clutch disk disposed between said first end of said drum and said drive sprocket;

(b) a first pressure plate carried by said drum shaft adjacent said second end of said drum means, said first pressure plate being rotatably fixed to said drum shaft but being axially movable relative to said drum shaft;

(c) a second clutch disk disposed between said second end of said drum and said first pressure plate;

(d) variable thrust means carried by said drum shaft and being adapted to urge said first pressure plate towards said second clutch disk and to urge said drum toward said drive sprocket in a manner such that said first clutch disk is urged against said drive sprocket; wherein said drum means is rotatably driven by said drum shaft and said drive sprocket; and (iv) an elongated flexible cable having first and second ends; wherein said first end is secured to said drum means, and wherein said cable is adapted to be wound around said drum means when said drum means is driven by said drum shaft.

12. A winch in accordance with claim 11, further comprising:

a second pressure plate carried by said drum shaft adjacent said second clutch disk; wherein said second pressure plate is rotationally fixed to said drum means;

wherein said variable thrust means includes a handle which is movable between first and second positions; wherein said variable thrust means is adapted to urge said first and second pressure plates towards said second clutch disk and to urge said first clutch disk against said drive sprocket; wherein said drum means is rotatably driven by said drum shaft and said drive sprocket.

13. A winch in accordance with claim 12, further comprising a third clutch disk secured to said second pressure plate on the surface facing said first pressure plate.

14. A winch in accordance with claim 13, wherein said first clutch disk is secured to said first end of said drum means; wherein said second clutch disk is secured to said second end of said drum means.

15. A winch in accordance with claim 12, wherein said drive means comprises:

(a) a motor including a power shaft which is driven in a rotatable manner;

(b) a gear box which includes an input shaft and said output shaft, wherein said power shaft of said motor means is operably connected to said input shaft of said gear box;

wherein said output shaft of said gear box is driven at a slower speed than said input shaft; wherein said output shaft is operably connected to said drive sprocket of said drum clutch assembly.

16. A winch in accordance with claim 15, wherein said motor means comprises an internal combustion engine.

17. A winch in accordance with claim 15, further comprising frame means adapted to support said gear box and said drum clutch assembly.

18. A winch in accordance with claim 17, wherein said lock means comprises a first lock bearing carried by said output shaft and supported by said frame means, wherein said lock bearing permits said output shaft to be rotatably driven in a forward direction and prevents said output shaft from being driven in a reverse direction.

19. A drum clutch assembly adapted for use in a winch system, said assembly comprising:

(a) an elongated shaft having first and second ends;

(b) support means adapted to support said ends of said shaft;

(c) drive means secured to said first end of said shaft; said drive means being adapted to rotatably drive said shaft;

(d) drum means rotatably carried on said shaft; wherein said drum means includes first and second ends;

(e) clutch means carried by said shaft and being adapted to selectively engage and disengage said drum means from said shaft; wherein said drum means is caused to rotate with said shaft when said clutch means is engaged; and wherein said drum means may be rotated independently of said shaft when said clutch means is disengaged; wherein said clutch means comprises:

(i) a first clutch disk disposed between said first end of said drum and said drive means;

(ii) a first pressure plate carried by said drum shaft adjacent said second end of said drum means, said first pressure plate being rotatably fixed to said drum shaft but being axially movable relative to said drum shaft;

(iii) a second clutch disk disposed between said second end of said drum and said first pressure plate;

(iv) a second pressure plate carried by said drum shaft adjacent said second clutch disk; wherein said second pressure plate is rotationally fixed to said drum means;

(v) variable thrust means carried by said drum shaft and being adapted to urge said first and second pressure plates towards said second clutch disk and to urge said first clutch disk against said drive means; wherein said drum means is rotatably driven by said drum shaft and said drive means; and (f) an elongated flexible cable having first and second ends, wherein said first end is secured to said drum means, and wherein said cable is adapted to be wound around said drum means when said drum means is driven by said shaft.

20. A drum clutch assembly in accordance with claim 19, further comprising a third clutch disk secured to said second pressure plate on the surface facing said first pressure plate.

21. A drum clutch assembly in accordance with claim 20, wherein said variable thrust means includes a handle which is movable between first and second positions to selectively engage and disengage said drum means from said drum shaft.

22. A drum clutch assembly in accordance with claim 19, further comprising an internal combustion engine adapted to power said drive means.

23. A drum clutch assembly in accordance with claim 19, further comprising a lock bearing carried by said shaft, wherein said lock bearing permits said shaft to be rotatably driven in a forward direction and prevents said shaft from being driven in a reverse direction.

* * * * *